US009248473B2

(12) United States Patent
Varkey et al.

(10) Patent No.: US 9,248,473 B2
(45) Date of Patent: Feb. 2, 2016

(54) POLYMER-BONDED METALLIC ELEMENTS USED AS STRENGTH MEMBERS, AND/OR POWER OR DATA CARRIERS IN OILFIELD CABLES

(75) Inventors: Joseph Varkey, Sugar Land, TX (US); Jushik Yun, Sugar Land, TX (US); Burcu Unal Altintas, Sugar Land, TX (US); Ricardo Vanegas, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 259 days.

(21) Appl. No.: 13/695,233

(22) PCT Filed: Apr. 29, 2011

(86) PCT No.: PCT/US2011/034545

§ 371 (c)(1), (2), (4) Date: May 10, 2013

(87) PCT Pub. No.: WO2011/137337

PCT Pub. Date: Nov. 3, 2011

(65) Prior Publication Data

US 2013/0233587 A1 Sep. 12, 2013

Related U.S. Application Data

(60) Provisional application No. 61/343,577, filed on Apr. 30, 2010.

(51) Int. Cl.
*B05D 7/14* (2006.01)
*E21B 17/00* (2006.01)
(Continued)

(52) U.S. Cl.
CPC ..... *B05D 7/14* (2013.01); *D07B 1/0693* (2013.01); *D07B 1/162* (2013.01); *E21B 17/003* (2013.01); *H01B 7/17* (2013.01); *D07B 1/147* (2013.01); *D07B 2201/2011* (2013.01); *D07B 2201/2012* (2013.01); *D07B 2201/2013* (2013.01);
(Continued)

(58) Field of Classification Search
CPC ..... B05D 7/14; H01B 7/17; E21B 17/003
USPC ..... 174/110 SR; 427/327, 318, 557; 428/379, 626, 605
See application file for complete search history.

(56) References Cited

U.S. PATENT DOCUMENTS 4,368,350 A * 1/1983 Perelman ..... 174/102 D
4,693,863 A * 9/1987 Del Corso et al. ..... 419/13
(Continued)

FOREIGN PATENT DOCUMENTS

EP 384606 A1 * 8/1990 ..... B32B 15/08
EP 1975309 A1 * 10/2008 ..... B60C 9/00

OTHER PUBLICATIONS

International Search Report of PCT Application Serial No. PCT/US11/34545 dated Jan. 17, 2012.

*Primary Examiner* — Timothy Thompson
*Assistant Examiner* — Charles Pizzuto
(74) *Attorney, Agent, or Firm* — Trevor Grove

(57) ABSTRACT

A method for manufacturing a component includes a step of providing at least one metallic element. A surface of the at least one metallic element is modified to facilitate a bonding of the at least one metallic element to a polymeric layer. The polymeric layer is then bonded to the at least one metallic element to form the component.

18 Claims, 6 Drawing Sheets

(51) Int. Cl.

| | |
|---|---|
| ***H01B 7/17*** | (2006.01) |
| ***D07B 1/06*** | (2006.01) |
| ***D07B 1/16*** | (2006.01) |
| *D07B 1/14* | (2006.01) |
| *H01B 7/04* | (2006.01) |

(52) U.S. Cl.

CPC . *D07B2201/2044* (2013.01); *D07B 2201/2059* (2013.01); *D07B 2201/2065* (2013.01); *D07B 2205/306* (2013.01); *D07B 2205/3021* (2013.01); *D07B 2205/3032* (2013.01); *D07B 2205/3067* (2013.01); *D07B 2207/404* (2013.01); *D07B 2207/4059* (2013.01); *H01B 7/046* (2013.01); *Y10T 428/12424* (2015.01); *Y10T 428/12569* (2015.01); *Y10T 428/294* (2015.01)

(56) References Cited

U.S. PATENT DOCUMENTS

| | | | | |
|---|---|---|---|---|
| 4,709,544 | A | 12/1987 | Charvet | |
| 4,832,443 | A * | 5/1989 | Cameron et al. | 385/101 |
| 5,545,262 | A | 8/1996 | Hardee et al. | |
| 5,981,919 | A * | 11/1999 | Masten, Jr. | 219/502 |
| 6,320,155 | B1 | 11/2001 | Barnett | |
| 6,412,263 | B1 | 7/2002 | Lee et al. | |
| 7,687,575 | B2 * | 3/2010 | Lee et al. | 525/78 |
| 2003/0001307 | A1 * | 1/2003 | Miller | 264/171.12 |
| 2004/0197578 | A1 * | 10/2004 | Sinsel et al. | 428/461 |
| 2006/0118322 | A1 * | 6/2006 | Wiekhorst et al. | 174/110 R |
| 2010/0097450 | A1 * | 4/2010 | Pugh et al. | 348/61 |
| 2010/0301502 | A1 * | 12/2010 | Ott et al. | 264/1.25 |
| 2011/0244721 | A1 * | 10/2011 | Amidon | 439/578 |

* cited by examiner

POLYMER-BONDED METALLIC ELEMENTS USED AS STRENGTH MEMBERS, AND/OR POWER OR DATA CARRIERS IN OILFIELD CABLES

BACKGROUND

The statements in this section merely provide background information related to the present disclosure and may not constitute prior art.

The disclosure is related in general to wellsite equipment such as oilfield surface equipment, oilfield cables and the like.

As oil and gas exploration evolves, wells are drilled to increasing depths and in increasingly harsh conditions. Cables used in the oilfield industry can be subjected to repeated physical stress, high temperatures, hydrocarbon solvents, and high concentrations of hydrogen sulfide ($H_2S$). Greater demands are being placed on electrical conductors to carry electricity to these increasing depths.

When polymer insulated or jacketed metallic members are run into and out of an oil well, there are mechanical forces acting at the interfaces between metals and polymers. There may be separation of polymer from the metallic interfaces due to the deformation of polymer when such components are bent, when the cable passes over sheaves or rollers, when the cable passes through a stuffing box or packers that are used for pressure control, when there is a coefficient of thermal expansion difference between polymer and metal, when there is gas migration between polymer and metal interface, and when any similar operations are performed. These physical stresses may cause the polymeric covering to pull away from the metal and leave air gaps. In the case of electrical conductors, these air gaps may lead to the development of coronas.

As shown in FIGS. 1A to 1B, a standard cable 2 having at least one metallic strand 4 and a non-bonded polymer insulation 6 may have small air gaps 7, even when initially manufactured. In particular, when the standard metallic cable 2 is subjected to repeated bending, for example, when passing over sheaves (not shown) or the like, the polymer insulation 6 may pull away from the at least one metallic strand 4 and create or increase a size of the air gaps 7. The air gaps 7 in turn may undesirably create coronas in the standard cable 2. The air gaps 7 may also undesirably create a pathway to allow downhole gases (such as corrosive Hydrogen sulfide or $H_2S$) to travel along the standard cable 2.

The presence of $H_2S$ in well fluids may result in failures when standard galvanized improved plow steel (GIPS) armor wires are used as strength members. $H_2S$ in the form of a gas or a gas dissolved in liquids may attack metals by combining with them to form metallic sulfides and atomic hydrogen. The destructive process is principally hydrogen embrittlement, accompanied by chemical attack. Chemical attack is commonly referred to as sulfide stress cracking. $H_2S$ attacks metals with a wide variation in intensity. Many commonly used carbon and alloy steels are susceptible to $H_2S$ damage. High-strength steels used in armor wires, which may have high carbon content and may be highly cold-worked, may be particularly susceptible to $H_2S$ damage.

Some metals and special alloys such as, for example, the nickel-steel alloy HC265, are very resistant to $H_2S$ attack. However, these special alloys may have much lower electrical conductivity than standard GIPS armor wire. This is a drawback in wireline operations, where armor wire is typically used as an electrical return path.

It remains desirable to provide improvements in wireline cables and/or downhole assemblies.

SUMMARY

In an embodiment, a method for manufacturing a component first includes providing at least one metallic element. A surface of the at least one metallic element is modified to facilitate bonding of the at least one metallic element to a polymeric layer. The polymeric layer is bonded to the at least one metallic element to form the component.

In an embodiment, modifying the surface of the at least one metallic element comprises heating the surface of the at least one metallic element. The heating facilitates bonding of the at least one metallic element to the polymeric layer. The heating is performed by passing the at least one metallic element adjacent a heat source, such as an infrared heat source. The at least one metallic element is thereby heated to a temperature of about 500° F. for a time sufficient to modify the surface. The at least one metallic element is also heated in a modifying fluid that modifies the surface of the at least one metallic element when heated. Bonding the at least one metallic element to the polymeric layer may further comprise extruding the polymeric layer over the at least one metallic element, whereby the polymeric layer is bonded to the at least one metallic element and forms the component.

In an embodiment, a component includes at least one metallic element having a modified surface, and a polymeric layer bonded to the at least one metallic element to form the component.

The embodiments discussed in this disclosure use a variety of metals, alloys and platings as well as polymer jacketing materials chosen for their insulating and chemical protective properties and their abilities to bond to metal.

The embodiments of the present disclosure particularly relate to polymer insulation/jackets that are chemically/mechanically bonded to the metal surface. The polymer insulation/jackets that are chemically/mechanically bonded to the metal surface are used to prevent separation of polymer from metal interface due to the dynamics of going over a sheave, through a stuffing box or packers that are used for pressure control, due to coefficient of thermal expansion difference between polymer and metal, and due to other operations in an oil well environment. The polymer insulation/jackets that are chemically/mechanically bonded to the metal surface further prevent gas migration between the polymer and metal interface.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1A:
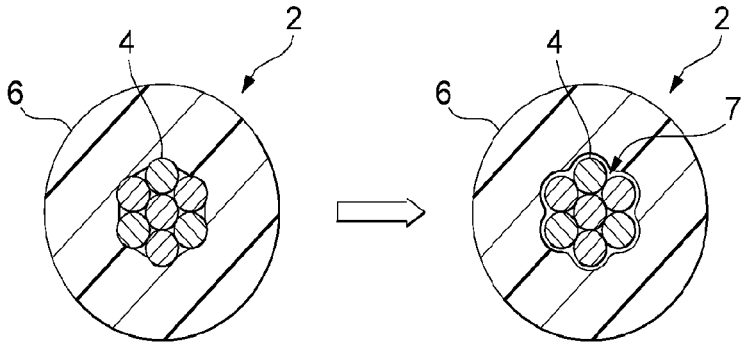
FIG.1A (PRIOR ART)
FIGS. 1A and 1B are radial cross-sectional views of cable components of the prior art, illustrating a formation of air gaps between a metallic wire and a polymeric coating following repeated bending of the cable component in operation.
Figure 1B:
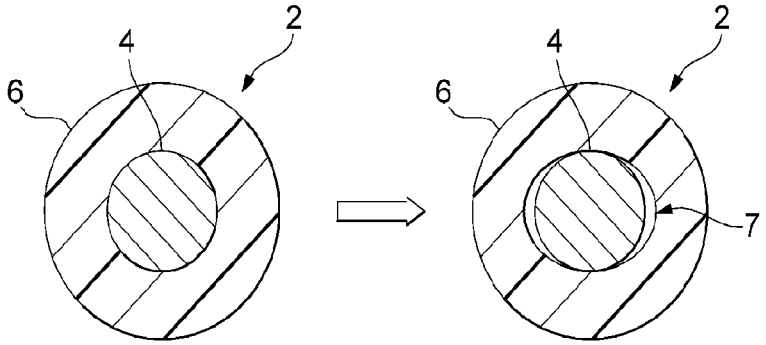
FIG.1B (PRIOR ART)

The methods described herein are for making and using metallic wire oilfield cable components with continuously bonded polymeric jackets. However, it should be understood that the methods may equally be applied to other metallic components having bonded polymeric jackets, and that methods for making and using such metallic components having bonded polymeric jackets are also within the scope of the present disclosure.

Bonding to the metal surface is used to prevent separation of polymer from metal at the polymer and metal interface due to the dynamics of going over a sheave, through a stuffing box or packers that are used for pressure control, and coefficient of thermal expansion differences between polymer and metal. Bonding to the metal surface is also used to prevent gas migration between polymer and metal interface. Bonding techniques include modifying metal surfaces through exposure to heat sources, such as infrared heat sources, to facilitate bonding with polymers, and using polymers amended to facilitate bonding with those metals. By eliminating the presence of gaps between the metallic components and the polymers extruded over those components, these embodiments may greatly minimize the occurrence of coronas and eliminate potential pathways for downhole gases inside the insulation. These embodiments may be advantageously used individually as slickline cables capable of telemetry transmission for battery-operated downhole tools, for example, as part of monocable or coaxial cable embodiments, as conductor or conductor/strength member components in hepta-configuration cables, and as components in other multi-conductor wireline cable configurations, as will be appreciated by those skilled in the art.

Metallic Wires

The metallic wires used at the cores of the components described in this disclosure may comprise copper-clad steel, aluminum-clad steel, anodized aluminum-clad steel, titanium-clad steel, Carpenter alloy 20Mo6HS, GD31Mo, austenitic stainless steel, galvanized carbon steel, copper, titanium clad copper GIPS wire, combinations thereof, or other metals, as will be appreciated by those skilled in the art.

Modified Polymer

The modified polymer may comprise modified polyolefins. Where needed to facilitate bonding between materials that would not otherwise bond, the described polymers may be amended with one of several adhesion promoters such as, but not limited to, unsaturated anhydrides, (mainly maleic-anhydride, or 5-norbornene2,3-dicarboxylic anhydride), carboxylic acid, acrylic acid, or silanes. Trade names of commercially available, amended polyolefins with these adhesion promoters may include ADMER© from Mitsui Chemical, Fusabond® and Bynel® from DuPont, and Polybond® from Chemtura. Other suitable adhesion promoters may also be employed, as desired.

The modified polymer may comprise modified TPX (4-methylpentene-1 based, crystalline polyolefin). Where needed to facilitate bonding between materials that would not otherwise bond, the described polymers may be amended with one of several adhesion promoters, such as, but not limited to, unsaturated anhydrides, (mainly maleic-anhydride, or 5-norbornene-2,3-dicarboxylic anhydride), carboxylic acid, acrylic acid, or silanes. TPX™ from Mitsui Chemical is a commercially available, amended TPX (4-methylpentene-1 based, crystalline polyolefin) comprising these adhesion promoters. Other suitable adhesion promoters may also be employed, as desired.

The modified polymer may comprise modified fluoropolymers. Modified fluoropolymers containing adhesion promoters may be used where needed to facilitate bonding between materials that would not otherwise bond. As listed above, these adhesion promoters may comprise unsaturated anhydrides, (mainly maleicanhydride or 5-norbornene-2,3-dicarboxylic anhydride), carboxylic acid, acrylic acid, and silanes). Examples of commercially available fluoropolymers modified with adhesion promoters include Tefzel® from DuPont Fluoropolymers, modified ETFE resin, which may be configured to promote adhesion between polyamide and fluoropolymer; Neoflon™-modified fluoropolymer from Daikin America, Inc., which is configured to promote adhesion between polyamide and fluoropolymer; ETFE (Ethylene tetrafluoroethylene) from Daikin America, Inc., or EFEP (ethylene-fluorinated ethylene propylene) from Daikin America, Inc.

Polymer Insulation—Unmodified and Reinforced which have Low Dielectrical Coefficient.

The polymer insulation may include, for example, commercially available polyolefins. The polyolefin may be used as is or reinforced with, carbon, glass, aramid or any other suitable natural or synthetic fiber. Along with fibers in polymer matrix, any other reinforcing additives such as, but not limited to, micron sized PTFE, graphite, Ceramer™, HDPE (High Density Polyethylene), LDPE (Low Density Polyethylene), PP (Ethylene tetrafluoroethylene), PP copolymer or similar materials may also be utilized.

The polymer insulation may also include, for example, commercially available fluoropolymers. The fluoropolymer may be used as is or reinforced with carbon, glass, aramid or any other suitable natural or synthetic fiber. Along with fibers in polymer matrix, any other reinforcing additives such as, but not limited to, micron sized PTFE, graphite, Ceramer™, ETFE (Ethylene tetrafluoroethylene) from Du Pont, ETFE (Ethylene tetrafluoroethylene) from Daikin America, Inc., EFEP (ethylene-fluorinated ethylene propylene) from Daikin America, Inc. PFA (perfluoroalkoxy polymer) from Dyneon™ fluoropolymer, PFA (perfluoroalkoxy polymer) from Solvay Slexis, Inc., PFA (perfluoroalkoxy polymer) from Daikin America, Inc., PFA (perfluoroalkoxy polymer) from DuPont Fluoropolymer, Inc., may also be used.

Jacketing Materials

The jacketing materials may comprise polyamide. Polyamides may comprise Nylon 6, Nylon 66, Nylon 6/66, Nylon 6/12, Nylon 6/10, Nylon 11, or Nylon 12. Trade names of commercially available versions of these polyamide materials may comprise Orgalloy®, RILSAN® or RILSAN® from Arkema, BASF Ultramid®, Miramid® from BASF, and Zytel® DuPont Engineering Polymers.

The jacketing materials may comprise unmodified or reinforced fluoropolymers. Commercially available fluoropolymers can be used as is or reinforced with carbon, glass, aramid or any other suitable natural or synthetic fiber, for example. Along with fibers in polymer matrix, any other reinforcing additives such as micron sized PTFE, graphite, Ceramer™, ETFE (Ethylene tetrafluoroethylene) from Du Pont, ETFE (Ethylene tetrafluoroethylene) from Daikin America, Inc., EFEP (ethylene-fluorinated ethylene propylene) from Daikin America, Inc., PFA (perfluoroalkoxy polymer) from Dyneon™ fluoropolymer, PFA (perfluoroalkoxy polymer) from Solvay Slexis, Inc., PFA (perfluoroalkoxy polymer) from Daikin America, Inc., PFA (perfluoroalkoxy polymer) from DuPont Fluoropolymer, Inc., may also be used.

Material Combinations

The materials and processes described hereinabove may be used to form a number of different types of metallic wire cable components, such as wireline cable components or the like, with continuously bonded polymeric jackets. First through fifth embodiments, discussed in more detail below, disclose different combinations of materials which may be used. In each embodiment, the metallic wire used may be any of those discussed above. The specific materials for polymeric layers are also discussed above. The heating and extrusion processes used may be any of those discussed hereinbelow.

Embodiment 1

Single or Stranded Metallic Strength Member or Conductor with Bonded Polymer Insulation As shown in FIGS. 2A to 2B and FIGS. 3A to 3D, a first embodiment includes a cable component 102 having a solid metallic element 104, for example, a single strand wire. It should be appreciated that other types of metallic elements 104 different from wires are also within the scope of the present disclosure. The metallic element 104 is covered in at least one polymeric layer 106. The at least one polymeric layer 106 of the present disclosure may include insulation layers, tie layers, and unmodified or modified polymer jacket layers, as described further herein, or other layers of polymers as desired.

In the method of the present disclosure, a surface 108 of the metallic element 104 is modified to facilitate a bonding between the metallic element 104 and the polymeric layer 106. The surface 108 may be modified by heating the metallic element 104 prior to extruding the polymeric layer 106 thereover to enhance the bonding. For example, the surface 108 may be heated through infrared heating, although other forms of heating are also within the scope of the present disclosure. The polymeric layer 106 forms the bonded polymer insulation of the cable component 102. The polymeric layer 106 may be modified to bond to the metallic element 104. The polymer of the polymeric layer 106 may be selected for its low dielectrical rating to offer enhanced telemetry capabilities.

Figure 2A:
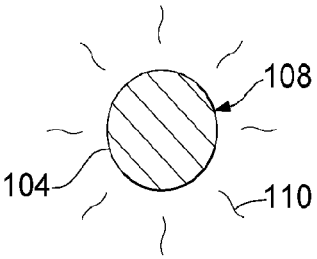
FIGS. 2A and 2B are radial cross-sectional views of a single strand cable component according to a first embodiment of the present disclosure, illustrating a method of manufacturing the single strand cable component.
Figure 2B:
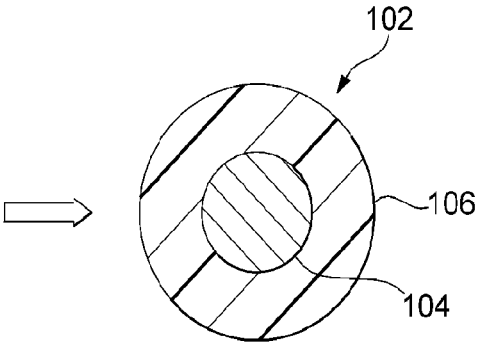

In FIG. 2A, the bare metallic element 104 is passed adjacent a heat source, such as an infrared heat source (not shown), to expose the surface 108 to infrared radiation 110 and heat the metallic element 104. The heating of the surface 108 modifies the surface 108 of the metallic element 104 and facilitates bonding. In FIG. 2B, the polymeric layer 106, which may be amended with a substance that allows it to bond to the metallic element 104, for example, is extruded over the metallic element 104. Nonlimiting examples for materials forming the cable component 102 according to the first embodiment may include modified EPC (ADMER®) bonded to copper cladded steel; modified ETFE (Tefzel®) bonded to copper cladded steel; modified EPC (ADMER®) bonded to HC265 or 27-7 Mo; modified ETFE (Tefzel®) bonded to HC265 or 27-7 Mo. A skilled artisan understands that other materials amended with substances that allow the material to bond to the metallic element 104 may also be employed, as desired.

As shown in FIGS. 3A to 3D, the first embodiment may also be practiced using a multi-stranded conductor, e.g., a multi-strand wire, as the metallic element 104. The bonded polymer strategy is used within the stranded wire to minimize the possibility of air gaps within the cable component 102.

Figures 3A, 3B, 3C, 3D:
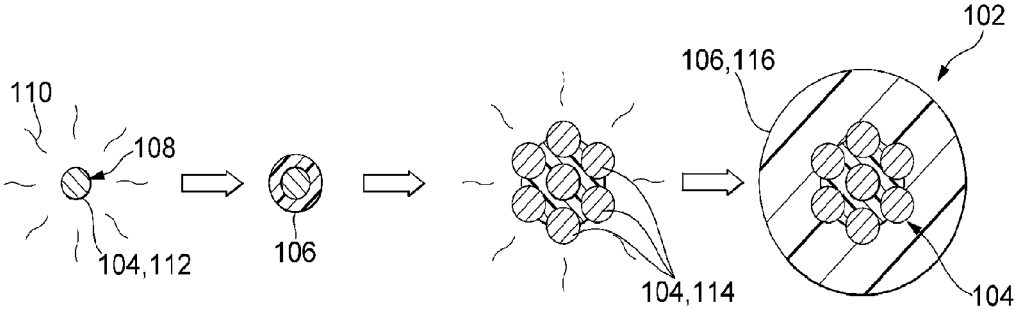
FIGS. 3A to 3D are radial cross-sectional views of a multi-strand cable component according to the first embodiment of the present disclosure, illustrating a method of manufacturing the multi-strand cable component.

In FIG. 3A, a central strand 112 of the metallic element 104 is passed through a heat source, such as an infrared heat source emitting infrared radiation 110 to facilitate bonding. In FIG. 3B, the polymeric layer 106, for example, modified to bond to the metal surface 108, is extruded over the treated central strand 112. In FIG. 3C, additional strands 114 of the metallic element 104 are passed through the infrared heat source emitting the infrared radiation 110 to modify the surface 108 of the additional metal strands 114 to facilitate bonding. The additional strands 114 are then helically wound or cabled onto and partially embedded into the polymeric layer 106 covering the central strand 112. In FIG. 3D, an insulation layer 116 comprising the same polymer material applied in FIG. 3B is extruded over the infrared-heat-source-treated additional strands 114 to complete the cable component 102.

One of ordinary skill in the art should appreciate that a variety of metal combinations may be used for the metallic element 104 in first embodiment including, but not limited to, copper-clad steel, aluminum-clad steel, anodized aluminum-clad steel, titanium-clad steel, Carpenter alloy 20Mo6HS, GD31Mo, austenitic stainless steel, high strength galvanized carbon steel, copper, and titanium clad copper. Other suitable metal combinations may also be used within the scope of the present disclosure.

Embodiment 2

Single or Stranded Metallic Core with Modified Polymer Tie Layer and Bonded Polymer Insulation As depicted in FIGS. 4A to 4C and FIGS. 5A to 5D, a second embodiment of the present disclosure is provided. The second embodiment is similar to the first embodiment. Like or related structures from FIGS. 2A to 3D that are also shown in FIGS. 4A to 5D have the same reference numerals but in a 200-series for the purpose of clarity.

Figures 4A, 4B, 4C:
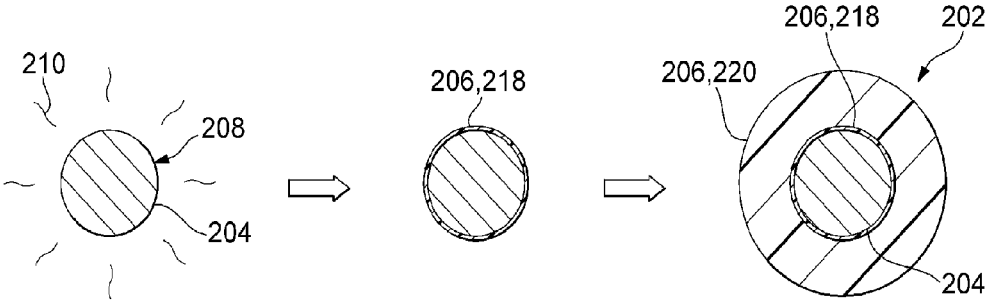
FIGS. 4A to 4C are radial cross-sectional views of a single strand cable component according to a second embodiment of the present disclosure, illustrating a method of manufacturing the single strand cable component.

In the second embodiment, the polymeric layer 206 includes a thin tie layer 218 of polymer that is modified to bond the metallic element 204 to an outer unmodified polymer insulation 220. The unmodified polymer insulation 220 may be chosen for its dielectrical properties to enhance telemetry capabilities of the cable component 202, for example. The basic process is depicted in FIGS. 4A to 4C. In FIG. 4A, the bare metallic element 204 is passed through a heat source, such as the infrared heat source (not shown), to modify the surface 208 of the metal with the infrared radiation 210 and facilitate bonding. In FIG. 4B, the thin tie layer 218 of polymer, amended with the substance that allows it to bond to the metal, is extruded over the metallic element 204. In FIG. 4C, the unmodified polymer insulation 220 of un-amended polymer insulation material is extruded over and bonded to the tie layer 218. Nonlimiting examples of materials forming the cable component 202 according to the second embodiment may include metal/modified EPC (ADMER®)/polyolefin, EPC; and metal/modified ETFE (Tefzel®)/ETFE (Tefzel®).

Figures 5A, 5B, 5C, 5D:
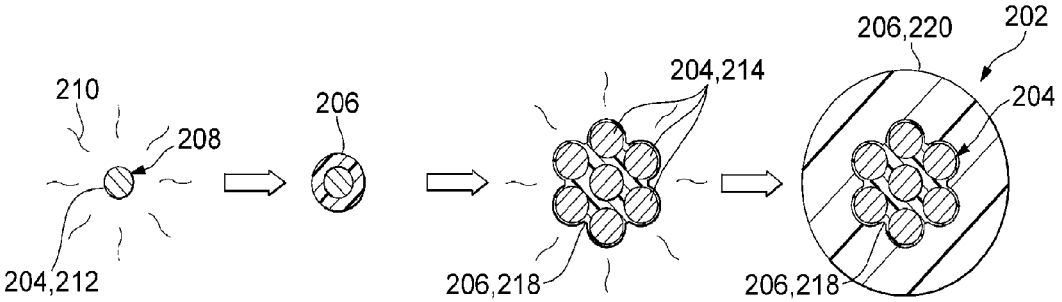
FIGS. 5A to 5D are radial cross-sectional views of a multi-strand cable component according to the second embodiment of the present disclosure, illustrating a method of manufacturing the multi-strand cable component.

As shown in FIGS. 5A to 5D, the second embodiment may also use multi-strand wire. The bonded polymer strategy is used within the multi-strand wire to minimize the possibility of air gaps within the cable component 202. In FIG. 5A, the central strand 212 of the metallic element 204 is passed through the infrared heat source emitting infrared radiation 210 to facilitate bonding. In FIG. 5B, the polymeric layer 206, preferably modified to bond to the metal surface 208, is extruded over the treated central strand 212. In FIG. 5C, the additional strands 214 of the metallic element 204 are passed through the infrared heat source to modify the surface 208 of the additional strands 214 to facilitate bonding. The additional strands 214 are then cabled or helically wound onto and partially embedded into the polymeric layer 206 covering the central strand 212. The thin tie layer 218 includes the same modified polymer applied in FIG. 5B and is extruded over the infrared-heat-source-treated additional strands 214 to facilitate bonding. In FIG. 5D, the unmodified polymer insulation 220 is extruded over and bonded to the tie layer 218 to complete the cable component 202.

One of ordinary skill in the art should appreciate that a variety of metal combinations may be used for the metallic element 204 of the second embodiment including, but not limited, to copper-clad steel, aluminum-clad steel, anodized aluminum-clad steel, titanium-clad steel, Carpenter alloy 20Mo6HS, GD31Mo, austenitic stainless steel, high strength galvanized carbon steel, copper, and titanium clad copper. Other suitable metal combinations may also be used within the scope of the present disclosure.

Embodiment 3

Metallic Core with Modified Polymer Tie Layer and Chemically Protective Virgin Outer Polymer Jacket As depicted in FIGS. 6A to 6C and FIGS. 7A to 7D, a third embodiment of the present disclosure is provided. The third embodiment is similar to the first embodiment and the second embodiment. Like or related structures from FIGS. 2A to 5D that are also shown in FIGS. 6A to 7D have the same reference numerals but in a 300-series for the purpose of clarity.

Figures 6A, 6B, 6C:
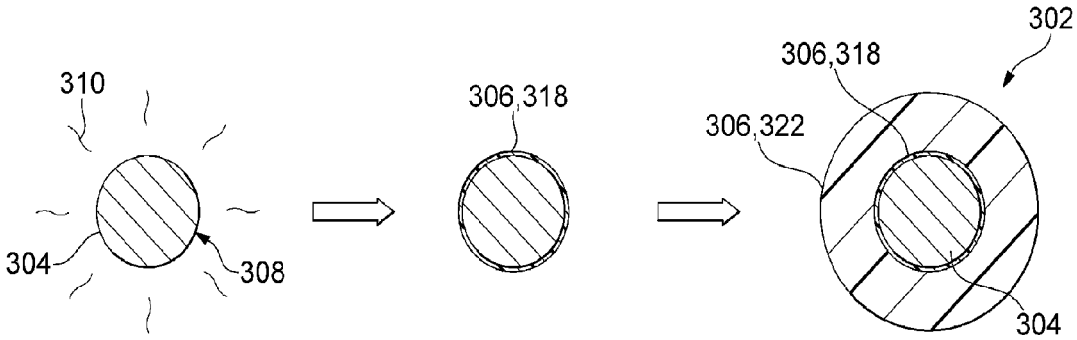
FIGS. 6A to 6C are radial cross-sectional views of a single strand cable component according to a third embodiment of the present disclosure, illustrating a method of manufacturing the single strand cable component.

In the third embodiment, the polymeric layer 306 includes a chemically protective virgin outer polymer jacket 322. The chemically protective virgin outer polymer jacket 322 is applied over the thin tie layer 318 of modified polymer to form or create a bond from the metallic element 304 to the chemically protective virgin outer polymer jacket 322. The unmodified polymer of the chemically protective virgin outer polymer jacket 322 is chosen for its chemically protective properties. In FIG. 6A, the bare metallic element 304 is passed through a heat source, such as the infrared heat source (not shown), to modify the surface 308 of the metal with the infrared radiation 310 and facilitate bonding. In FIG. 6B, the thin tie layer 318 of polymer, amended with the substance that allows it to bond to the metal surface 308, is extruded over the metallic element 304. In FIG. 6C, the chemically protective virgin outer polymer jacket 322 (e.g., polyolefin, fluoropolymer, etc.) is extruded over and bonded to the tie layer 318. Nonlimiting examples of the cable component 302 according to the third embodiment may include metal/modified EPC (ADMER®)/polyolefin, EPC; metal/modified ETFE (Tefzel®)/modified fluoropolymer; and metal/modified EPC (ADMER®)/polyolefin, EPC.

Figures 7A, 7B, 7C, 7D:
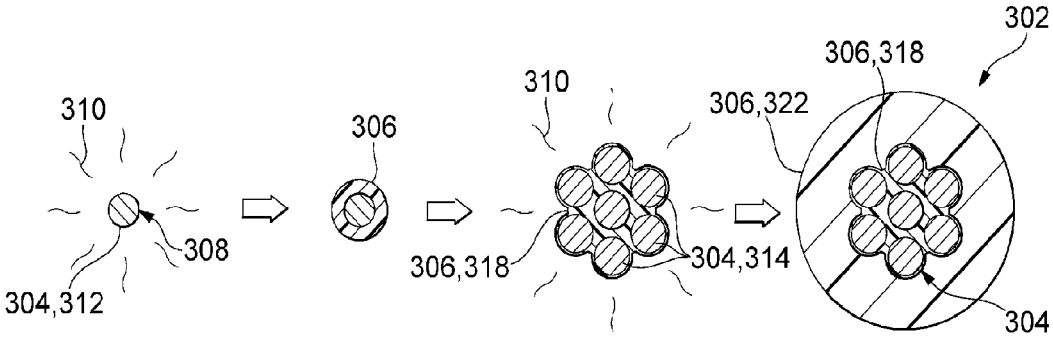
FIGS. 7A to 7D are radial cross-sectional views of a multi-strand cable component according to the third embodiment of the present disclosure, illustrating a method of manufacturing the multi-strand cable component.

As shown in FIGS. 7A to 7D, the third embodiment may also be practiced using the multi-strand metallic element 304. The bonded polymer strategy is used within the multi-strand wire to minimize the possibility of air gaps. In FIG. 7A, the central strand 312 of the metallic element 304 is passed through the infrared heat source emitting infrared radiation 310 to facilitate bonding. In FIG. 7B, the polymeric layer 306, preferably in the form of the tie layer 318 modified to bond to the metal surface 308, is extruded over the treated central strand 312. In FIG. 7C, the additional strands 314 are passed through the infrared heat source to modify the surface 308 of the additional strands 314 to facilitate bonding. The additional strands 314 are then cabled or helically wound onto and partially embedded into the polymeric layer 306 covering the central strand 312. The thin tie layer 318 including the same modified polymer applied in FIG. 7B is extruded over the infrared-heat-source-treated additional strands 314 to facilitate bonding. In FIG. 7D, the chemically protective virgin outer polymer jacket 322 is extruded over and bonded to the tie layer 318 to complete the cable component 302.

One of ordinary skill in the art should appreciate that a variety of metal combinations may be used for the metallic element 304 of the third embodiment including, but not limited to, copper-clad steel, aluminum-clad steel, anodized aluminum-clad steel, titanium-clad steel, Carpenter alloy 20Mo6HS, GD31Mo, austenitic stainless steel, high strength galvanized carbon steel, copper, and titanium clad copper. Other suitable metal combinations may also be used within the scope of the present disclosure.

Embodiments 4 and 5

Solid or Stranded Metallic Core with Modified Bonded Polymer(S) and Chemically Protective and Possibly Reinforced Outer Jacket As depicted in FIGS. 8A to 8C and 9A to 9E, a fourth embodiment of the present disclosure is provided. FIGS. 10A to 10D and 11A to 11E depict a fifth embodiment of the present disclosure. Each of the fourth embodiment and the fifth embodiment combines features of the first and second embodiments with the chemically protective outer jacket of the third embodiment. Like or related structures from FIGS. 2A to 7D that are also shown in FIGS. 8A to 9E have the same reference numerals but in a 400-series for the purpose of clarity. Like or related structures from FIGS. 2A to 9E that are also shown in FIGS. 10A to 11E have the same reference numerals but in a 500-series for the purpose of clarity.

In the fourth embodiment, the amended polymeric layer 406 is extruded directly over the metallic element 404, followed by the chemically protective polymeric outer jacket 422. In the fifth embodiment, the thin tie layer 518 bonds the metallic element 504 to the unmodified polymer insulation 520, followed by the chemically protective polymeric outer jacket 522. The metallic element 404, 504 may either be solid as shown in FIGS. 8A to 8C, or multi-stranded as shown in FIGS. 9A to 9E.

Figures 8A, 8B, 8C:
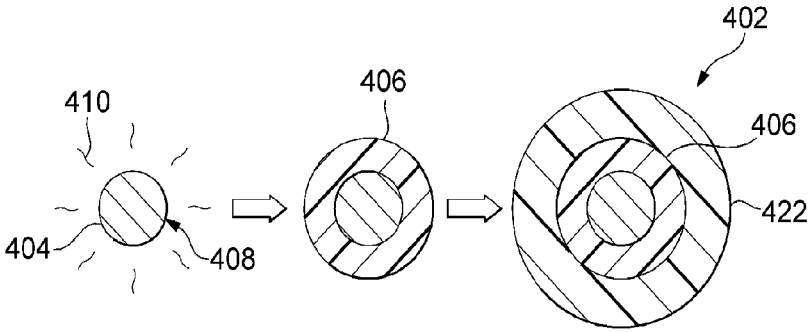
FIGS. 8A to 8C are radial cross-sectional views of a single strand cable component according to a fourth embodiment of the present disclosure, illustrating a method of manufacturing the single strand cable component.

In FIG. 8A, the solid metallic element 404 is passed through a heat source, such as the infrared heat source (not shown) to modify the metal's surface with the infrared radiation 410 and facilitate bonding. In FIG. 8B, the amended polymeric layer 406 is extruded over and bonds to the infrared-heat-modified metallic element 404. In FIG. 8C, the chemically protective polymeric outer jacket 422 is extruded over the amended polymeric layer 406 to form the cable component 402. The chemically protective polymeric outer jacket 422 may be unmodified virgin polymer, or a reinforced polymer, as desired. Nonlimiting examples of the cable component 402 according to the fourth embodiment of the disclosure may include: metal/modified EPC (ADMER®) as insulation/polyolefin, EPC; metal/modified ETFE (Tefzel®) as insulation/fluoropolymer; and metal/modified EPC (ADMER®) as insulation/polyolefin, EPC.

Figures 9A, 9B, 9C, 9D, 9E:
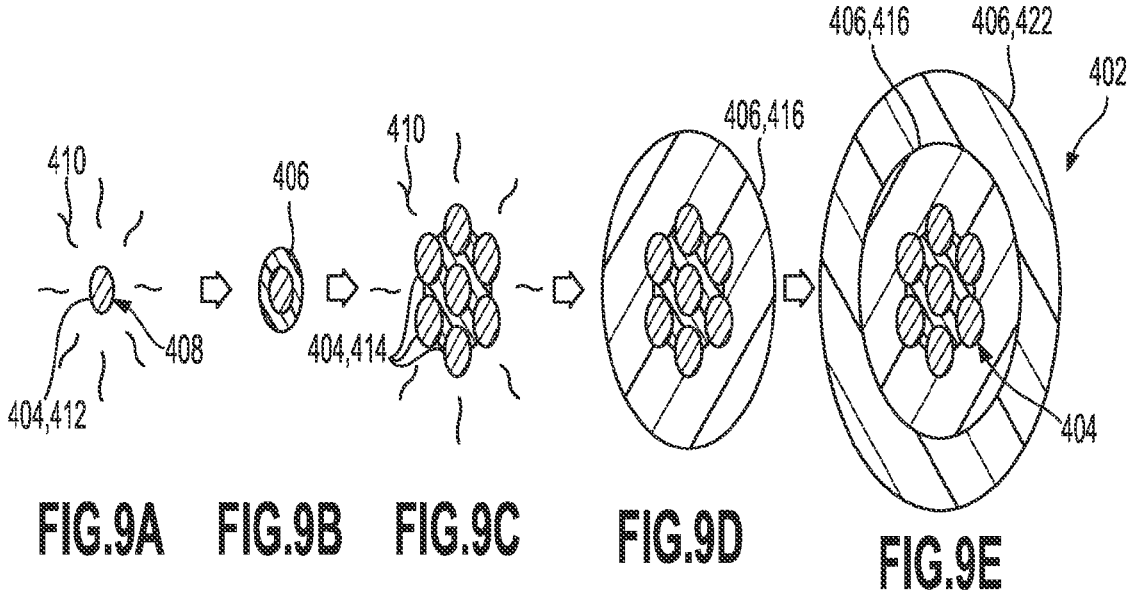
FIGS. 9A to 9E are radial cross-sectional views of a multi-strand cable component according to the fourth embodiment of the present disclosure, illustrating a method of manufacturing the multi-strand cable component.

As shown in FIGS. 9A to 9E, the fourth embodiment may also be practiced using the multi-strand metallic element 404. The bonded polymer strategy is used within the multi-strand metallic element 404 to minimize the possibility of air gaps. In FIG. 9A, the central strand 412 of the multi-strand metallic element 404 is passed through the infrared heat source emitting the infrared radiation 410 to facilitate bonding. In FIG. 9B, the amended polymeric layer 406, modified to bond to the metal surface 408, is extruded over the treated central strand 412. In FIG. 9C, the additional strands 414 are passed through the infrared heat source to modify the surface 408 of the additional strands 414 to facilitate bonding. The additional strands 414 are then cabled or helically wound onto and partially embedded into the amended polymeric layer 406 covering the central strand 412. In FIG. 9D, the same amended modified polymer applied in FIG. 9B is extruded over and bonded to the infrared-heat-source-treated additional strands 414 to form the insulation layer 416. In FIG. 9E, the chemically protective virgin outer polymer jacket 422, or a reinforced polymer, is extruded over and bonded to the polymer layer 406 to complete the cable component 402.

One of ordinary skill in the art should appreciate that a variety of metal combinations may be used for the metallic element 404 of the fourth embodiment including, but not limited to, copper-clad steel, aluminum-clad steel, anodized aluminum-clad steel, titanium-clad steel, Carpenter alloy 20Mo6HS, GD31Mo, austenitic stainless steel, high strength galvanized carbon steel, copper, and titanium clad copper). Other suitable metal combinations may also be used within the scope of the present disclosure.

Figures 10A, 10B, 10C, 10D:
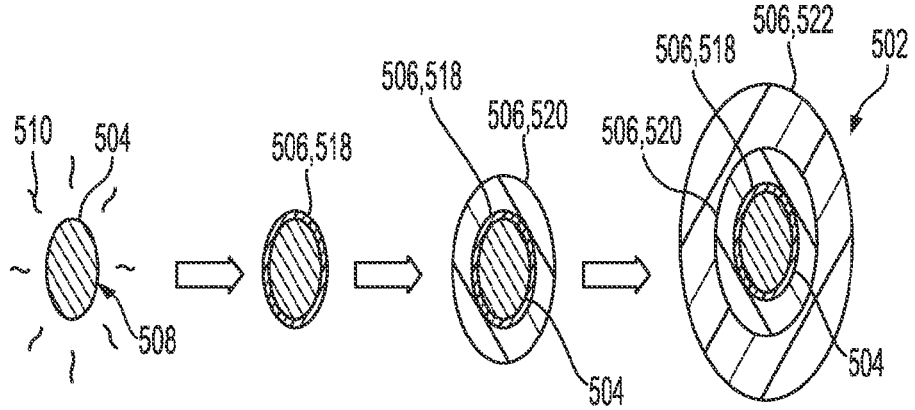
FIGS. 10A to 10D are radial cross-sectional views of a single strand cable component according to a fifth embodiment of the present disclosure, illustrating a method of manufacturing the single strand cable component.

The fifth embodiment of the disclosure is shown in FIGS. 10A to 10D. In FIG. 10A, the solid metallic element 504 is passed through the infrared heat source (not shown) to modify the metal's surface 508 with the infrared radiation 510 and facilitate bonding. In FIG. 10B, the thin tie layer 518 of modified polymer insulation is extruded over and bonds to the infrared-heat-modified metallic element 504. In FIG. 10C, the unmodified polymer insulation 520 of is extruded over and bonds to the tie layer 518. In FIG. 10D, the chemically protective virgin outer polymer jacket 522 is extruded over and bonded to the unmodified polymer insulation 520. The chemically protective virgin outer polymer jacket 522 may be unmodified virgin fluoropolymer, or a reinforced fluoropolymer, for example. Nonlimiting examples of the cable component 502 may include combinations of metal/modified EPC (ADMER®)/polyolefin, EPC or PP/Reinforced ETFE; metal/modified ETFE (Tefzel®)/ETFE ((Tefzel)/reinforced ET FE; metal/modified EPC (ADMER®)/modified ETFE (Tefzel)/reinforced or virgin fluoropolymer; metal/modified EPC (ADMER®)/nylon/modified fluoropolymer/fluoropolymer; and metal/modified FEP (Neoflon™)/fluoropolymer/reinforced fluoropolymer.

Figures 11A, 11B, 11C, 11D, 11E:
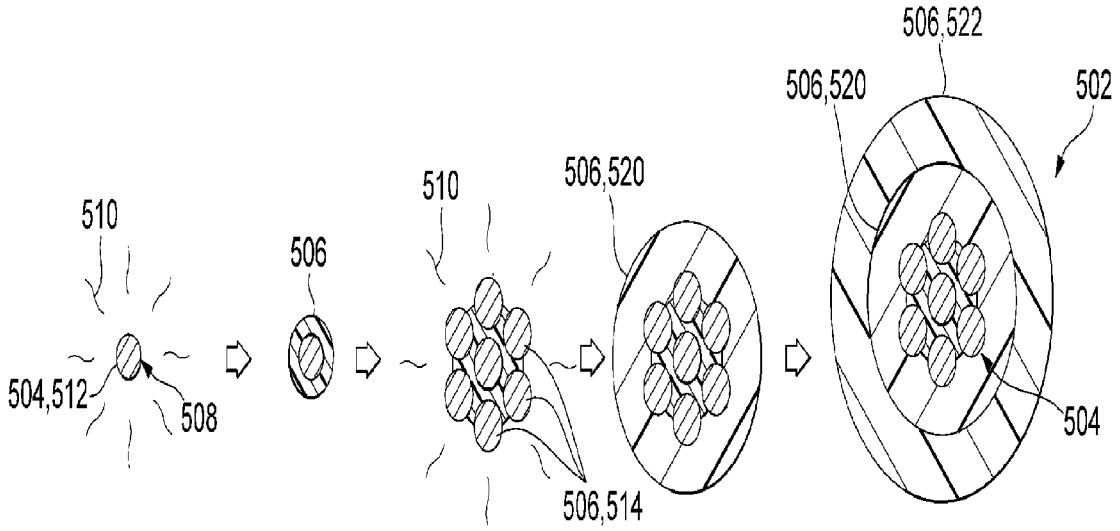
FIGS. 11A to 11E are radial cross-sectional views of a multi-strand cable component according to the fifth embodiment of the present disclosure, illustrating a method of manufacturing the multi-strand cable component.
Figures 13A, 13B, 13C, 13D:
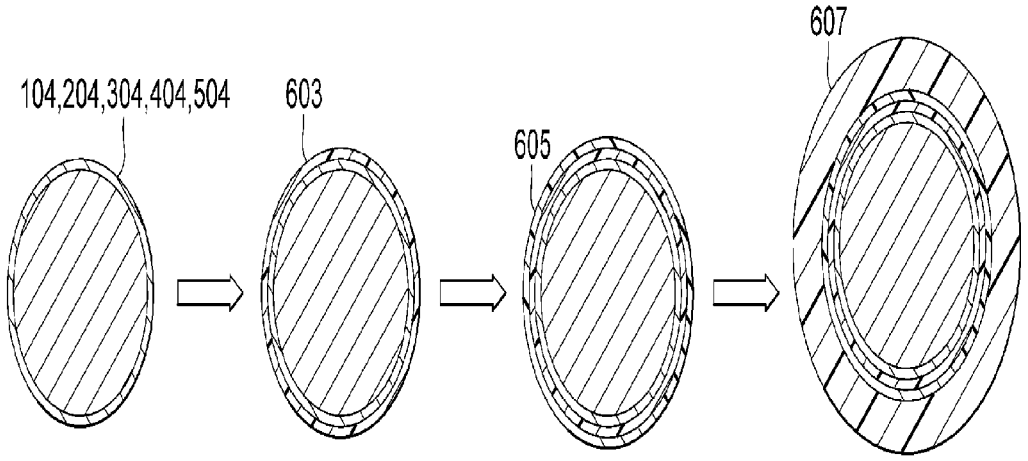
FIGS. 13A to 13D are radial cross-sectional views of a single strand cable component, illustrating a method of manufacturing the single strand cable component with the tandem extrusion process illustrated in FIG. 12.

As shown in FIGS. 11A to 11E, the fifth embodiment may also be practiced using the multi-strand metallic element 504. The bonded polymer strategy may be used within the multi-strand metallic element 504 to minimize the possibility of air gaps. In FIG. 11A, the central strand 512 of the multi-strand metallic element 504 is passed through a heat source, such as the infrared heat source, emitting the infrared radiation 510 to facilitate bonding. In FIG. 11B, the amended polymeric layer 506, modified to bond to the metal surface 508, is extruded over the treated central strand 512. In FIG. 11C, additional strands 514 are passed through the infrared heat source to modify the surface 508 of the additional strands 514 to facilitate bonding. The additional strands 514 are then cabled or helically wound onto and partially embedded into the amended polymeric layer 506 covering the central strand 512. In FIG. 11D, instead of using the tie layer 518, the insulating layer 520 of the same amended polymer applied in FIG. 11B may be extruded over and bonded to the infrared-heat-source-treated additional strands 514. In FIG. 11E, the chemically protective virgin outer polymer jacket 522, which may be unmodified virgin fluoropolymer or a reinforced fluoropolymer, for example, is extruded over and bonded to the insulation layer 520 to complete the cable component 502.

One of ordinary skill in the art should appreciate that a variety of metal combinations may be used for the metallic element 504 of the fifth embodiment including, but not limited to, copper-clad steel, aluminum-clad steel, anodized aluminum-clad steel, titanium-clad steel, Carpenter alloy 20Mo6HS, GD31Mo, austenitic stainless steel, high strength galvanized carbon steel, copper, and titanium clad copper. Other suitable metal combinations may also be used within the scope of the present disclosure.

Wire and Polymer Heating

To facilitate bonding between successive layers in the various embodiments disclosed herein, the surface 108, 208, 308, 408, 508 of a current outer layer (either the inner metallic element 104, 204, 304, 404, 504 or one of the polymeric layers 106, 206, 306, 406, 506) is heated and, in the case of a polymeric layer 106, 206, 306, 406, 506, melted slightly immediately prior to the next polymer being extruded onto the cable component 102, 202, 302, 402, 502. These processes can be applied during the addition of any of the polymeric layers 106, 206, 306, 406, 506.

The process of the present disclosure may be better facilitated by adding small amounts of short carbon fibers (such as about 1% to about 10% weight) into the polymer matrices used in the polymeric layers 106, 206, 306, 406, 506. In general, carbon fibers are electromagnetically reflective. As a result, electromagnetic (EM) waves (heat) transfer more quickly and efficiently to the polymer matrix. This optimized heating of the polymer matrix may reduce polymer melting times, minimize potentially damaging heat exposure, and enables greatly increased production line speeds for armor-wire-caging and jacket-extrusion processes.

Process Heating Methods to Facilitate Bonding or Embed Metallic Elements into Polymeric Layers A variety of heating methods may be used alone or in combination to embed metallic elements 104, 204, 304, 404, 504 into the polymeric layers 106, 206, 306, 406, 506 or facilitate bonding between the polymeric layers 106, 206, 306, 406, 506 as required in the embodiments described in this disclosure. Suitable heating methods may include, but are not limited to, infrared heaters emitting short, medium or long infrared waves; ultrasonic waves; microwaves; lasers; other suitable electromagnetic waves; conventional heating; induction heating; and combinations thereof, as will be appreciated by those skilled in the art.

The metallic element 104, 204, 304, 404, 504 is heated to a temperature sufficient to modify the surface 108, 208, 308, 408, 508 of the metallic element 104, 204, 304, 404, 504, for example, in a modifying fluid. As a nonlimiting example, the modifying fluid is ambient air and the surface 108, 208, 308, 408, 508 of the metallic element 104, 204, 304, 404, 504 is modified when heated in the air by reacting with oxygen in the air. Other modifying fluids suitable for modifying the surface 108, 208, 308, 408, 508 of the metallic element 104, 204, 304, 404, 504 when heated, and thereby facilitate a bonding of the metallic element 104, 204, 304, 404, 504 to the polymeric layers 106, 206, 306, 406, 506, may also be employed within the scope of the present disclosure.

In particular embodiments, the at least one metallic element 104, 204, 304, 404, 504 is heated to a temperature of at least about 500° F. In a most particular embodiment, the metallic element 104, 204, 304, 404, 504 is heated to a temperature between about 800° F. and about 1000° F. A skilled artisan may select other suitable temperatures to which to heat the metallic element 104, 204, 304, 404, 504 to modify the surface 108, 208, 308, 408, 508, and increase bonding with the polymeric layers 106, 206, 306, 406, 506, as desired.

Multi-Layer Extrusion Processes

Figure 12:
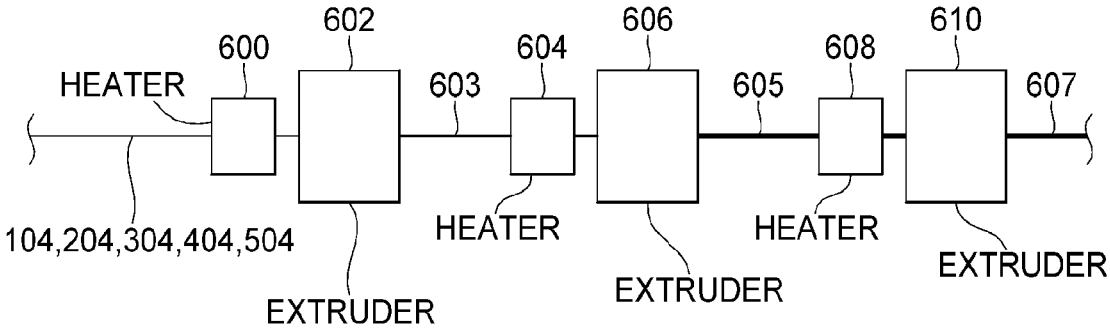
FIG. 12 shows a tandem extrusion process for manufacturing a cable component according to the present disclosure.

Multi-pass extrusion (where a single polymeric layer 106, 206, 306, 406, 506 is applied on each extrusion line), tandem extrusion (see FIG. 12), or co-extrusion (see FIG. 14) methods may be used to apply the various polymeric layers 106, 206, 306, 406, 506 including insulation layers, jackets, and adhesive tie-layers required for the embodiments disclosed herein. As described above, once the inner jacket layer has been applied, some form of EM heating or conventional heating of the cable component 102, 202, 302, 402, 502 is required before the cable core enters the extrusion crosshead for each successive polymeric layer 106, 206, 306, 406, 506 to be applied. This heating facilitates bonding between the polymeric layers 106, 206, 306, 406, 506 of the armored polymer jacket system.

With reference to FIGS. 12 and 13A to 13D, an exemplary tandem extrusion process includes providing the metallic element 104, 204, 304, 404, 504 such as plated wire and surface heating the metallic element 104, 204, 304, 404, 504 in a first heater 600. The metallic element 104, 204, 304, 404, 504 is then inserted through a first extruder 602 where a first one 603 of the polymeric layers 106, 206, 306, 406, 506 such as the tie layer 118, 218, 318, 418, 518, is extruded on the metallic element 104, 204, 304, 404, 504. The metallic element 104, 204, 304, 404, 504 with the first one 603 of the polymeric layers 106, 206, 306, 406, 506 is then heated in a second heater 604 prior to being inserted into a second extruder 606. In the second extruder, a second one 605 of the polymeric layers 106, 206, 306, 406, 506 is extruded on the first one 603 of the polymeric layers 106, 206, 306, 406, 506. Following the second extruder 606, the metallic element 104, 204, 304, 404, 504 with the first and second ones 603, 605 of the polymeric layers 106, 206, 306, 406, 506 is heated in a third heater 608 prior to being inserted into a third extruder 610. In the third extruder 610, a third one 607 of the polymeric layers 106, 206, 306, 406, 506 is extruded on the second one 605 of the polymeric layers 106, 206, 306, 406, 506. The cable component 102, 202, 302, 402, 502, manufactured by the tandem extrusion process of the disclosure is thereby provided.

Figure 14:
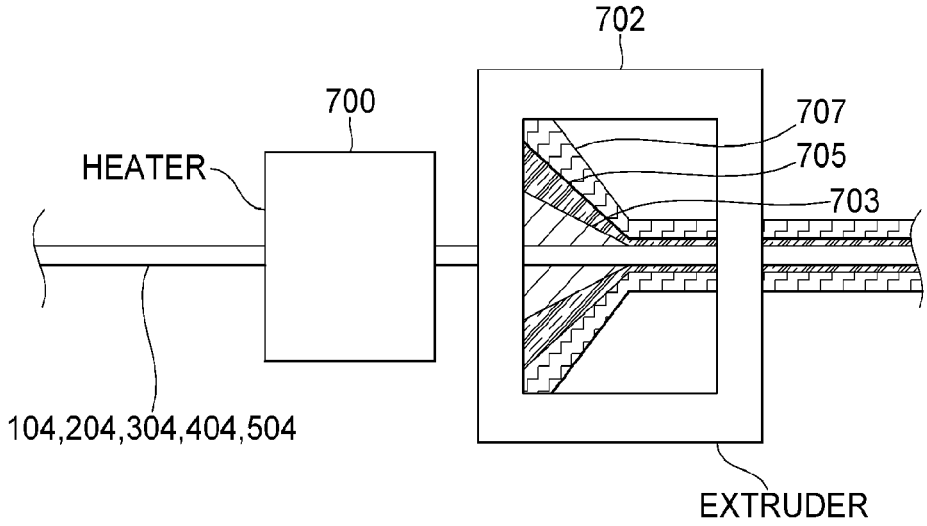
FIG. 14 shows a coextrusion process for manufacturing a cable component according to the present disclosure.
Figures 15A, 15B:
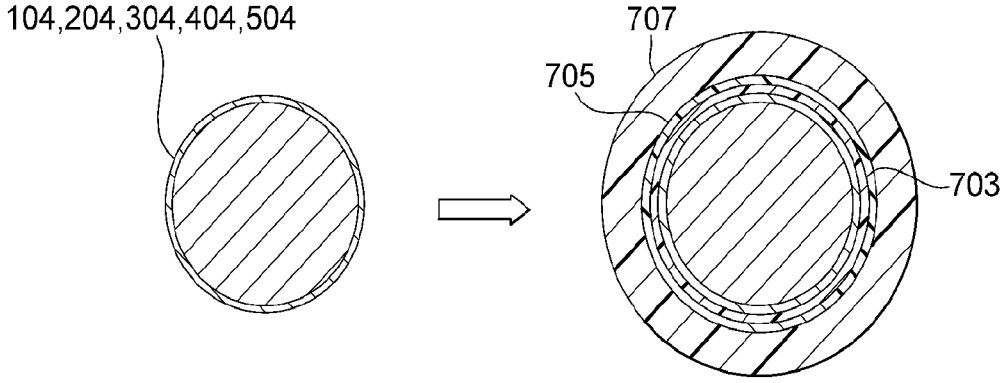
FIGS. 15A and 15B are radial cross-sectional views of a single strand cable component, illustrating a method of manufacturing the single strand cable component with the coextrusion process illustrated in FIG. 14.

Referring now to FIGS. 14 and 15A to 15B, an exemplary co-extrusion process includes providing the metallic element 104, 204, 304, 404, 504 such as plated wire and surface heating the metallic element 104, 204, 304, 404, 504 in a primary heater 700. Multiple ones 703, 705, 707 of the polymeric layers 106, 206, 306, 406, 506 are then simultaneously applied to the metallic element 104, 204, 304, 404, 504 in a co-extruder 702. The cable component 102, 202, 302, 402, 502, manufactured by the co-extrusion process of the disclosure is thereby provided.

Whenever possible, co-extrusion of the polymeric layers 106, 206, 306, 406, 506 including the insulation layers, the jacket layers, and the tie-layers may be preferred to maximize adhesion. In particular, co-extrusion may provide longer diffusion time and chemical reaction time between the polymeric layers 106, 206, 306, 406, 506 at elevated temperatures, may keep polymer melt temperature in co-extrusion head from cooling, and may provide higher contact pressure between the polymeric layers 106, 206, 306, 406, 506 than the tandem extrusion process.

Suitable applications for the cables 102, 202, 302, 402, 502 described hereinabove may include: slickline cables or multiline cables, wherein these components may be used as single or multiple strength members or strength and power/data carriers; wireline logging cables, wherein these components may be used as strength members, or combination strength and power/data carriers—cable configurations may be mono, coaxial, hepta, quad, triad or any other configuration; and seismic and oceanographic cables, wherein these elements or components may be used as strength members or combination strength and power carriers.

The polymer-bonded metallic components 102, 202, 302, 402, 502 may be advantageously utilized as strength members, and/or power or data carriers in oilfield cables. However, it should be understood that the methods may equally be applied to other metallic components having bonded polymeric jackets, and that methods for making and using such metallic components having bonded polymeric jackets are also within the scope of the present disclosure.

The preceding description has been presented with reference to present embodiments. Persons skilled in the art and technology to which this disclosure pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

We claim:

1. A method for manufacturing a component, comprising: providing at least one metallic element;

modifying a surface of the at least one metallic element to facilitate a bonding of the at least one metallic element to a modified polymeric layer;

bonding the modified polymeric layer to the at least one metallic element placing a tie layer about the modified polymeric layer; and bonding a virgin polymer jacket to the tie layer.

2. The method of claim 1, wherein the modifying comprises heating the at least one metallic element prior to bonding the polymeric layer to the at least one metallic element.

3. The method of claim 2, wherein heating comprises passing the at least one metallic element adjacent an infrared heat source.

4. The method of claim 2, wherein heating comprises heating the at least one metallic element to a temperature of at least about 500° F.

5. The method of claim 4, wherein heating comprises heating the at least one metallic element to a temperature between about 800° and about 1000° F.

6. The method of claim 2, wherein heating comprises heating the at least one metallic element in a modifying fluid that modifies the surface of the at least one metallic element when heated.

7. The method of claim 6, wherein the modifying fluid is air and the surface is modified by reaction with oxygen in the air when the at least one metallic element is heated.

8. The method of claim 1, wherein the modified polymeric layer comprises a bonded insulation layer.

9. The method of claim 1, further comprising extruding the virgin polymer jacket about the tie layer and heating the tie layer prior to extruding the virgin polymer jacket layer.

10. The method of claim 1, wherein bonding comprises extruding the modified polymeric layer over the at least one metallic element.

11. The method of claim 10, wherein the extruding comprises performing one of a tandem extrusion process and a co-extrusion process.

12. A method for manufacturing a component, comprising:

providing at least one metallic element;

heating a surface of the at least one metallic element to modify the surface and facilitate a bonding of the at least one metallic element to a polymeric layer, the heating performed by passing the at least one metallic element adjacent an infrared heat source, the at least one metallic element heated to a temperature of about 500° F. for a time sufficient to modify the surface, the at least one metallic element heated in a modifying fluid that modifies the surface of the at least one metallic element when heated; and extruding the polymeric layer over the at least one metallic element to bond the polymeric layer to the at least one metallic element;

placing a tie layer about the polymeric layer; and bonding a outer polymer jacket to the tie layer.

13. A component, comprising:

at least one metallic element having a modified surface; and a polymeric layer bonded to the at least one metallic element;

a tie layer bonded with the polymeric layer; and an outer polymer jacket disposed about the tie layer.

14. The component of claim 13, wherein the at least one metallic element is formed from one of copper-clad steel, aluminum-clad steel, anodized aluminum-clad steel, titanium-clad steel, carpenter alloy 20Mo6HS, GD31Mo, austenitic stainless steel, high strength galvanized carbon steel, copper, titanium clad copper, and combinations thereof.

15. The component of claim 13, wherein the polymeric layer comprises at least one of a modified polyolefin, a modified TPX, a modified polyolefin, and a modified fluoropolymer.

16. The component of claim 13, wherein the polymeric layer, tie layer, and outer polymer layer are continuously bonded.

17. The component of claim 13, wherein the at least one metallic element comprises one of a single strand metallic wire and a multi-strand metallic wire.

18. The component of claim 13, wherein the component comprises one of a wireline cable, a seismic cable, and a slickline cable.

* * * * *